US007918771B2

(12) United States Patent
Rogers et al.

(10) Patent No.: US 7,918,771 B2
(45) Date of Patent: Apr. 5, 2011

(54) WEIGHTLIFTING SYSTEM WITH OMNI DIRECTIONAL WEIGHT ARMS

(75) Inventors: Orley David Rogers, Sanford, MI (US); Kenneth Edward Staten, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 1061 days.

(21) Appl. No.: 11/326,095

(22) Filed: Jan. 5, 2006

(65) Prior Publication Data

US 2007/0155596 A1 Jul. 5, 2007

(51) Int. Cl.
*A63B 21/062* (2006.01)
*A63B 21/08* (2006.01)

(52) U.S. Cl. ..... 482/100; 482/97

(58) Field of Classification Search ..... 482/94, 482/97, 98, 100–104, 92–93, 99, 133–138, 482/139; 248/125.2, 125.8, 125.9, 188.2
See application file for complete search history.

(56) References Cited

U.S. PATENT DOCUMENTS

| | | | | |
|---|---|---|---|---|
| 4,753,126 | A * | 6/1988 | Sammaratano | 74/526 |
| 4,842,270 | A * | 6/1989 | Lange | 482/101 |
| 4,861,024 | A | 8/1989 | Lee | |
| 5,215,510 | A | 6/1993 | Baran | |
| 5,669,859 | A | 9/1997 | Liggett et al. | |
| 5,788,614 | A * | 8/1998 | Simonson | 482/97 |
| D444,827 | S | 7/2001 | Mobley | |
| 6,605,023 | B1 | 8/2003 | Mobley | |
| 6,623,407 | B2 | 9/2003 | Novak et al. | |
| 6,623,409 | B1 | 9/2003 | Abelbeck | |
| 6,669,607 | B2 | 12/2003 | Slawinski et al. | |
| 7,094,185 | B2 * | 8/2006 | Greenland | 482/100 |
| 7,641,602 | B2 * | 1/2010 | Rogers et al. | 482/100 |

* cited by examiner

*Primary Examiner* — Loan Thanh
*Assistant Examiner* — Oren Ginsberg
(74) *Attorney, Agent, or Firm* — Carlson, Gaskey & Olds PC

(57) ABSTRACT

A weightlifting system includes a weight arm system which may include various arm systems such as an incline arm system or a decline arm system. The weight arm system includes a weight arm mounted to a bracket assembly through an omni directional pivot system to permit the weight arm to pivot about a first axis and a second axis. The first axis is defined along the length of the bracket assembly while the second axis is transverse thereto. The combination of the movement about the first and second axis relative the bracket assembly permits the novel omni directional movement.

31 Claims, 5 Drawing Sheets

WEIGHTLIFTING SYSTEM WITH OMNI DIRECTIONAL WEIGHT ARMS

BACKGROUND OF THE INVENTION

The present invention relates to weightlifting equipment, and more particularly to an omni directional attachment for a multitude of weight arms.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. Oftentimes it is desirable to simulate the range of motion of free weights within a controlled environment. Most machines however are limited to a two dimensional plane of movement. Although effective, numerous machines are required as each machine is typically dedicated to only a few or a single exercise.

Machines are also relatively limited in the amount of weight which is contained within the machines stack of plates. As such, machines are undesirable for power lifting and for the training of powerful weightlifters who may find the stack of plates to be less than their capabilities.

Accordingly, it is desirable to provide a weightlifting system which will support a significant amount of weight, yet provide omni-directional movement in a controlled environment.

SUMMARY OF THE INVENTION

A weightlifting system according to the present invention includes a weight arm system which includes various arm systems such as an incline arm system or a decline arm system. The incline arm system typically permits exercises which develop legs, hips, chest shoulder and arm muscles amongst others; while the decline arm system typically permits core exercises. Such exercises are exemplarily only and other exercises may be performed—all of which are beneficially improved through the omni directional movement facilitated by an omni directional pivot system through which the weight arm system are mounted to a weight rack. The omni directional pivot system combines the improved neuromuscular development typical of free weights exercises within the controlled environment typical of a machine.

The weight arm system includes a weight arm mounted to a bracket assembly through the omni directional pivot system to permit the weight arm to pivot about a first axis and a second axis. The first axis is defined along the length of the bracket assembly while the second axis is transverse thereto. The combination of the movement about the first and second axis relative bracket assembly permits the novel omni directional movement.

The present invention therefore desirable to provide a weightlifting system which will support a significant amount of weight, yet provide omni-directional movement in a controlled environment.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
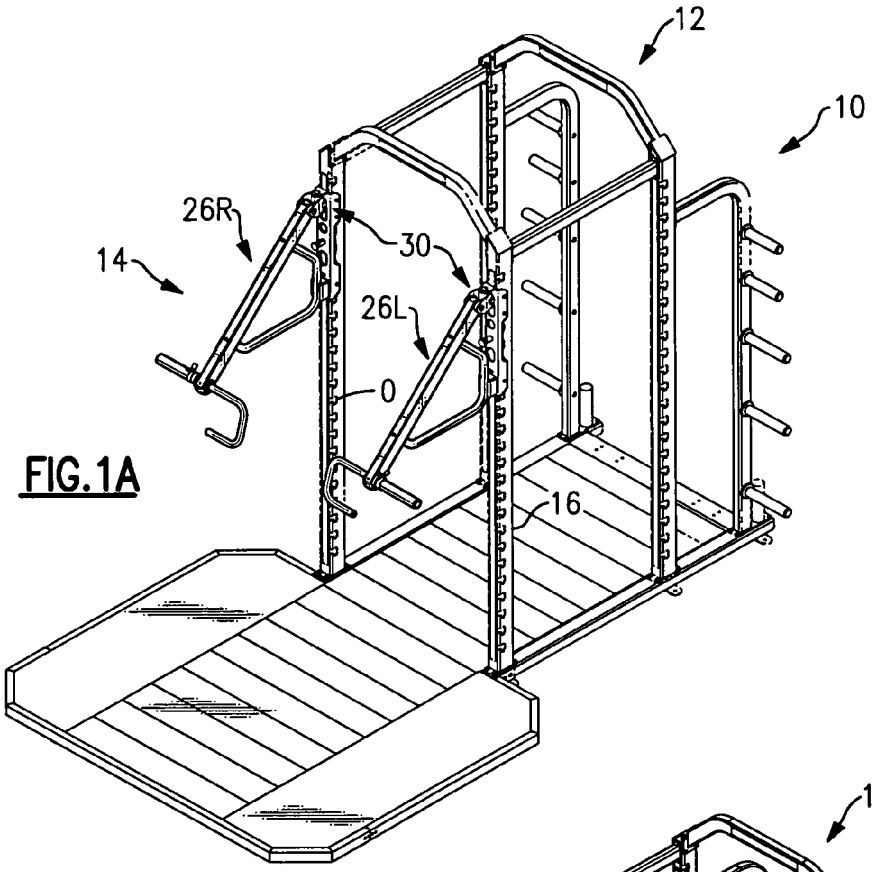
FIG. 1A is a perspective view of a weightlifting system with an incline arm system attached thereto.
Figure 1B:
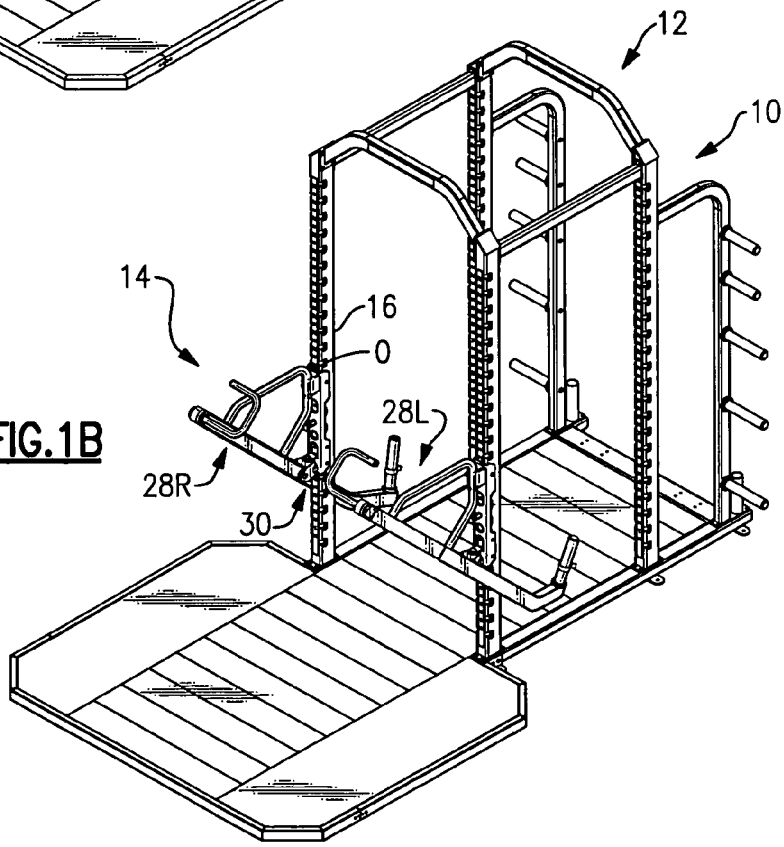
FIG. 1B is a weightlifting system with a decline arm system attached thereto.

FIG. 1A and 1B illustrates a perspective view of a weightlifting system 10 which includes a weight bar frame rack 12 for mounting a multitude of various weight arm systems 14. The frame rack 12 includes a multitude of openings O along an upright frame member 16 which receives the weight arm system 14 which may be located at various positions along the frame member 16. Each opening O is separated from the next by approximately four inches to provide significant incremental adjustment, however, any separation will be usable with the present invention.

Figure 2:
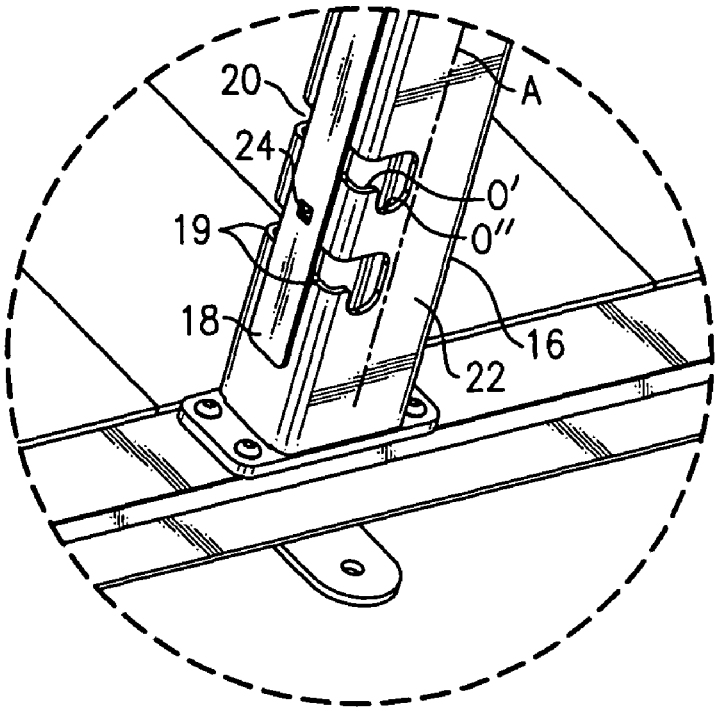
FIG. 2 is an expanded view of the weightlifting frame rack of FIGS. 1A and 1B.
Figure 3:
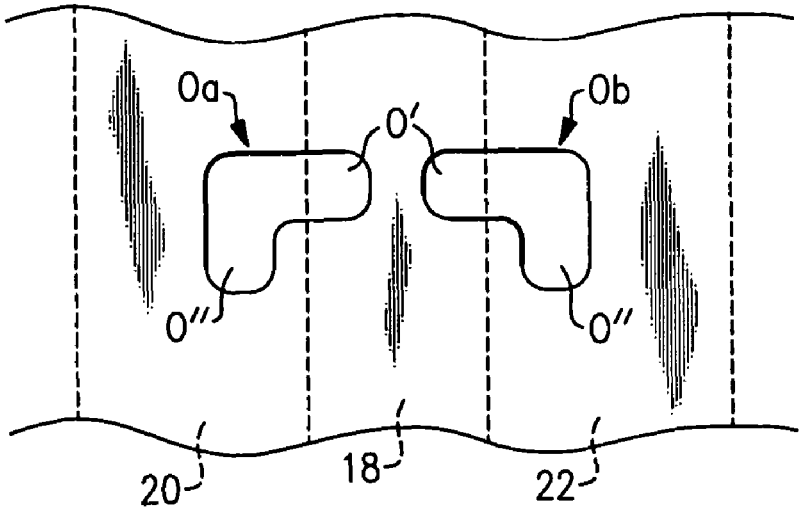
FIG. 3 is a schematic view of an opening in a weightlifting system frame rack upright.

Referring to FIG. 2, each upright frame member 16 defines a longitudinal axis A which extends vertically relative to the ground. The upright frame member 16 is generally rectilinear in shape and is preferably manufactured of tubing which is rectangular in cross-section. The upright frame member 16 includes a front face 18 and a first and second side face 20, 22. Each opening O spans the intersection of the front face 18 and one of the side faces 20, 22. In other words, each opening O cuts through the corner of the upright frame member 16. Each opening O includes a first opening portion O' in the front face 18 generally transverse to the longitudinal axis A and a second opening portion O" through the respective side face 20, 22 generally parallel to the longitudinal axis A. That is, the opening portions O' and O" are generally perpendicular if laid flat (FIG. 3). Preferably, each opening O includes relatively large corner radiuses.

The openings O are arranged in horizontally opposed pairs of openings Oa, Ob perpendicular to the longitudinal axis A (best seen in FIG. 3). That is, each pair of openings O includes a first opening Oa located through the front face 18 and the first side face 20 and a second opening Ob located through the front face 18 and the second side face 22 such that the openings Oa, Ob are aligned when viewed from one of the side faces 20, 22 (best seen in FIG. 3).

A lock opening 24 is located through the front face 18 between each vertically separated pair of openings Oa, Ob. Each lock opening 24 is displaced parallel to the longitudinal axis A and is generally square in shape. It should be understood that other shapes will also be readily usable with the present invention. Preferably, the lock opening 24 is longitudinally staggered above each pair of openings Oa, Ob. For further understanding of other aspects of the rack system, attachment thereto and associated components thereof, attention is directed to U.S. patent application Ser. No. 11/326,099 filed Jan. 5, 2006 and entitled: WEIGHTLIFTING SUPPORT ASSEMBLY which is assigned to the assignee of the instant invention and which is hereby incorporated herein in its entirety.

Figure 4A:
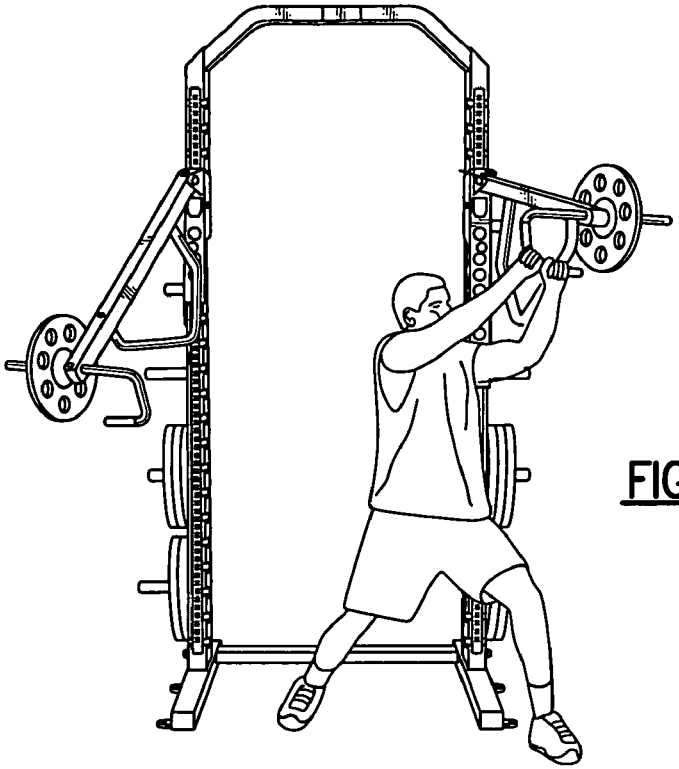
FIG. 4A is an example of the incline arm system in use.
Figure 4B:
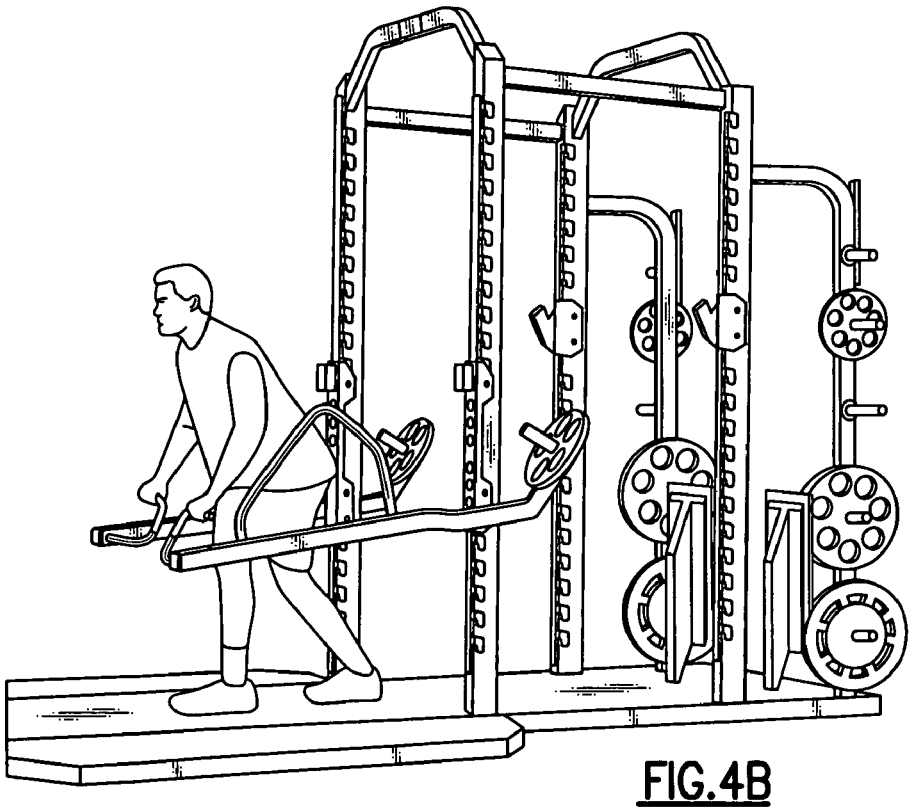
FIG. 4B is an example view of the decline arm system in use.

The weight arm system 14 may include various arm systems such as an incline arm system 26 (FIG. 1A) or a decline arm system 28 (FIG. 1B). The incline arm system 26 typically permits exercises which develop legs, hips, chest shoulder and arm muscles amongst (FIG. 4A) while the decline arm system 28 typically permits core exercises (FIG. 4B). It should be understood that such exercises are exemplarily only and that other exercises may be performed—all of which are beneficially improved through the omni directional movement facilitated by the omni directional pivot system 30 through which the weight arm system 14 are mounted. The omni directional pivot system 30 combines the improved neuromuscular development typical of free weights exercises within the controlled environment typical of a machine. It should be understood that although a particular frame arrangement is illustrated in the disclosed embodiment, other arrangements will be usable with the present invention.

Figure 5A:
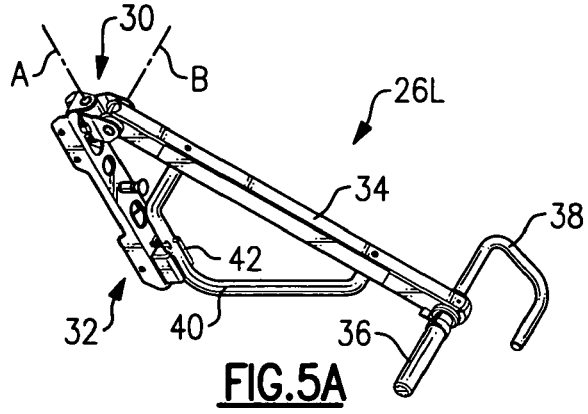
FIG. 5A is a perspective view of an incline arm system according to the present invention.

Referring to FIG. 5A, a left hand incline arm system 26L generally includes a bracket assembly 32, a weight arm 34, a weight horn 36, a handle 38 and a stop 40. The weight arm 34 may be of various configuration depending upon the desired exercises which are to be performed therewith. For example, a left hand decline arm system 28L (FIG. 5B) includes a weight arm 34D which locates the weight horn 36D and the handle 38D at generally opposite ends as compared to the incline arm system 26 which locates the weight horn 36 and handle 38 generally toward one end. It should be understood that although left arms are disclosed in the illustrated embodiment right arms (FIGS. 1A, 1B, 2A, 2B) are likewise constructed.

Figure 6B:
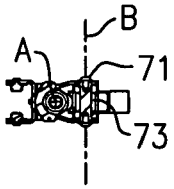
FIG. 6B is a top view of the incline arm system illustrated in FIG. 5A
Figure 6A:
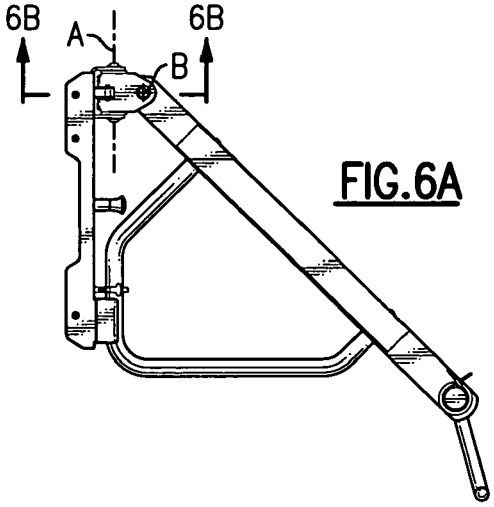
FIG. 6A is a side view of the incline arm illustrated in FIG. 5A.

The weight arm 34 is mounted to the bracket assembly 32 through the omni directional pivot system 30 which permits the weight arm 34 to pivot about a first axis A and a second axis B. The first axis A is preferably defined along the length of the bracket assembly 32 while the second axis B is transverse thereto (also illustrated in FIGS. 6A and 6B). The combination of the movement about the first and second axis A, B relative bracket assembly 32 permits the novel omni directional movement (such as shown in FIG. 4A).

The stop 40 is preferably a tubular structure mounted to the weight arm 34 to support the weight arm 34 when in a rest position (illustrated in FIG. 4). The bracket assembly 32 also includes a bumper 42 which receives the stop 40 when the weight arm 34 is in the rest position.

Figure 5B:
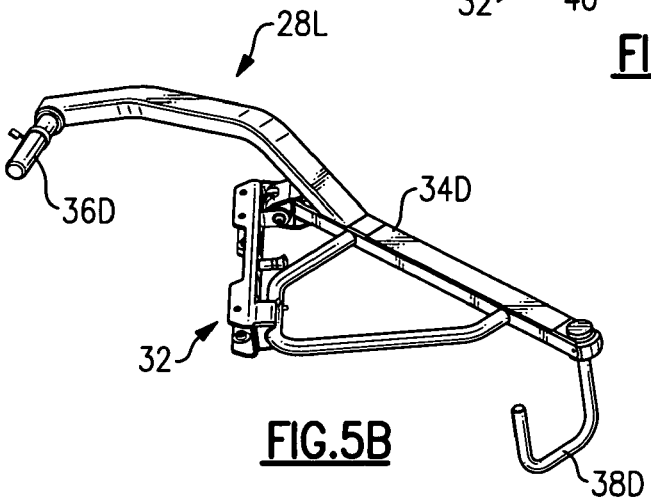
FIG. 5B is a perspective view of a decline arm system according to the present invention.
Figure 7A:
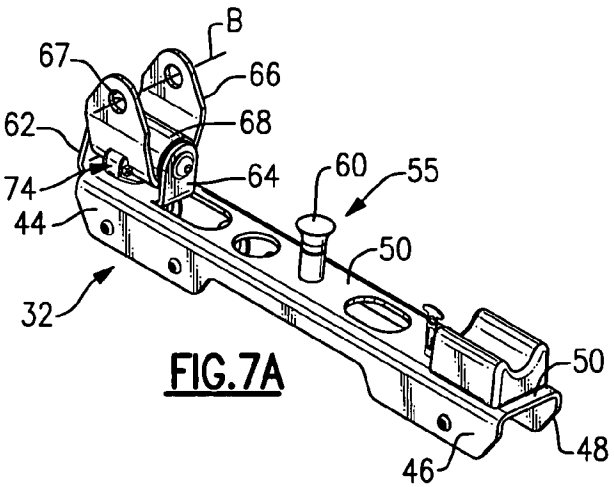
FIG. 7A is a perspective view of a bracket subassembly utilized for the incline arm system of FIG. 5A and the decline arm system of FIG. 5B.

Referring to FIG. 7A, the bracket assembly 32 is preferably common to both the incline arm system 26 (FIG. 5A) and the decline arm system 28 (FIG. 5B). The bracket assembly 32 includes a mount 44 which is generally U-shaped in cross-section. The mount 44 includes a first mount plate 46 opposed to and generally parallel with a second mount plate 48. The mount plates 46, 48 extend generally perpendicularly from a central mount plate 50 to form the generally U-shape. Preferably, the mount 44 is manufactured from a single, integral U-channel member.

Figure 7E:
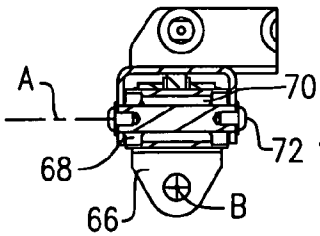
FIG. 7E is a sectional view of the pivot assembly of FIG. 7D taken along line 7E-7E.
Figure 7D:
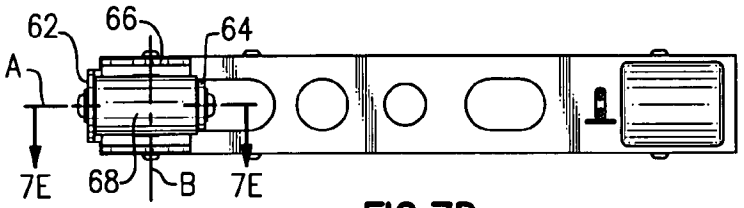
FIG. 7D is a front view of the bracket subassembly illustrated in FIG. 7A.
Figure 7C:
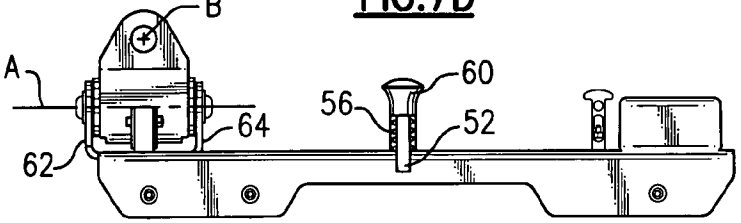
FIG. 7C is a side view of the bracket subassembly illustrated in FIG. 7A.
Figure 7B:
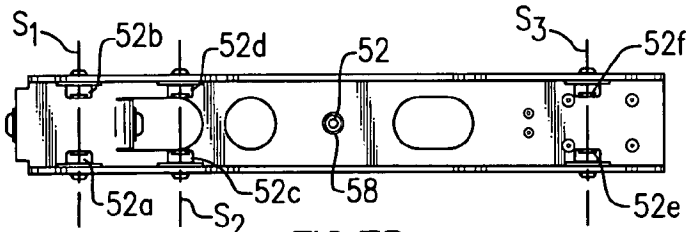
FIG. 7B is a rear view of the bracket subassembly illustrated in FIG. 7A.

A multitude of mount studs 52 (six shown; FIG. 7B) extend from an inner surface of the mount plates 46, 48 to engage the openings O (FIG. 2). The first stud 52*a* extends from the first mount plate 46 and is directly opposed to a second stud 52*b* which extends from an inner surface of the second mount plate 48 along a common axis S1. Likewise, the third stud 52*c* and the fourth stud 52*d* are located along a common axis S2 while the fifth stud 52*e* and the sixth stud 52*f* are located along a common axis S3. The axes S1, S2, S3 are spaced to correspond with the distance between the openings O (FIG. 1A). The studs 52*a*-52*f* are relatively significant solid members which mount through the mount plates 46, 48 with fasteners or the like.

A release knob assembly 55 is mounted to the central mount plate 50 such that a biased latch member 52 extends therethrough. The latch member 52 is preferably a pin which is biased by a spring 56 (FIG. 7C) or the like such that the latch member 54 extends through a latch aperture 58 (FIG. 7B) within the central mount plate 50 to engage the lock opening 24 (FIG. 2). The release knob assembly 55 is actuated by pulling a knob 60 to retract the latch member 52 toward and at least partially through the central mount plate 50 over the bias of the spring 56.

The omni directional pivot system 30 is preferably formed directly from the central mount plate 50. That is, a first mount arm 62 and a second mount arm 64 are cut out of bent away from the central mount plate 50 to provide an exceedingly robust structure.

An arm attachment mount 66 is preferably welded to a pivot pin 68 (also illustrated in FIG. 7D) which is mounted between the arms 62, 64. The arm attachment mount 66 includes apertures 67 which receive fasteners 72 such as bolts to pivotally attach the weight arm for pivotal movement about an arm pin 73 which defines axis B (also shown in FIGS. 6B and 7E). The pivot pin 68 preferably includes a cylindrical bearing 70 (FIG. 7E) attached to the arms 62, 64 with fasteners 72 to define the axis A. The arm attachment mount 66 preferably includes a centering device 74 such as a resilient pivot bumper which assists in centering the weight arm 34 but does not restrict pivotal movement. The centering device may preferably provide at least some force feedback to the user.

In use, a desired arm system is selectively attached to a desired position along the weight bar frame rack 12 by locating the studs 52*a*-52*f* adjacent to openings O at a desired height. That is, the bracket assembly 32 is slideably mountable along a longitudinal axis that extends along its length. The bracket assembly 32 is pushed toward the upright frame member 16 such that the studs 52*a*-52*f* are located into the first opening portions O' (FIG. 2). The studs 52*a*-52*f* are then guided downward by the second opening portion O". Concurrent therewith, the latch member 54 is pushed at least partially through the central mount plate 50 over the bias of the spring 56 by interaction with the front face 18 of the upright frame member 16. As the studs 52*a*-52*f* slide down toward the bottom of the second opening portions O" the latch member 54 encounters an adjacent lock opening 24. When the studs 52*a*-52*f* reach the bottom of the second opening portions O", the latch member 54 is biased into the lock opening 24 by the spring 56. The bracket assembly 32 is thereby securely locked into place. Notably, the bracket assembly 32 is supported upon the studs 52*a*-52*f* which provide an exceedingly robust support structure. The interaction between latch member 54 and lock opening 24 only locks the bracket assembly 32 at a desired position.

To remove the bracket assembly 32, the knob 60 is retracted to overcome the bias of the spring 56 to retract the latch member 54 from the lock opening 24. The bracket assembly 32 is then lifted up and out of the openings O. As the openings O include corners with significantly large radii, the studs 52*a*-52*f* are readily guided thereby.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weightlifting weight arm system comprising:

a bracket assembly that includes a length that extends along a longitudinal axis, wherein said bracket assembly is slideably mountable along said longitudinal axis;

an omni directional pivot system mounted to said bracket assembly, said omni directional pivot system defines a first pivot axis and a second pivot axis; and a weight arm mounted to said omni directional pivot system and pivotable about said first pivot axis and said second pivot axis, wherein said bracket assembly is selectively detachable from a weight bar frame rack.

2. The system as recited in claim 1, wherein said first axis is defined along said length of said bracket assembly and said second axis is transverse thereto.

3. The system as recited in claim 1, wherein said bracket assembly comprises:

a first mount plate;

a second mount plate generally parallel to said first mount plate;

a first stud which extends from said first mount plate; and a second stud which extends from said second mount plate, said second stud facing toward said first stud.

4. The system as recited in claim 3, wherein said first stud and said second stud are defined along a first stud axis.

5. The system as recited in claim 3, further comprising a release knob assembly mounted to a central mount plate mounted to said first mount plate and said second mount plate.

6. The system as recited in claim 3, wherein said first mount plate and said second mount plate extend from a central mount plate to form a generally U-shape.

7. The system as recited in claim 6, further comprising a non-metallic bumper mounted to said central mount plate.

8. The system as recited in claim 6, wherein said omni directional pivot system includes a first mount arm and a second mount arm cut out from said central mount plate, said first axis defined through said first mount arm and said second mount arm.

9. The system as recited in claim 1, further comprising a stop mounted to said weight arm.

10. The system as recited in claim 9, wherein said stop includes a tubular structure.

11. The system as recited in claim 1, further comprising a weight horn mounted to said weight arm.

12. The system as recited in claim 1, further comprising a handle mounted to said weight arm.

13. The system as recited in claim 1, further comprising a handle mounted to said weight arm opposite a weight horn.

14. The system as recited in claim 1, wherein said omni directional pivot system includes a first mount arm and a second mount arm, said first axis, defined through said first mount arm and said second mount arm.

15. The system as recited in claim 1, wherein said weight arm includes an incline arm system.

16. The system as recited in claim 1, wherein said weight arm includes a decline arm system.

17. A bracket assembly for a weightlifting system, comprising:

a mount;

an omni directional pivot system positioned on said mount and including a first pivot axis and a second pivot axis; and a bumper mounted to said mount at an opposite end of said mount from said omni directional pivot system, wherein said bumper receives a stop of the weightlifting system, wherein at least a portion of said omni directional pivot system is cut out from said mount.

18. The bracket assembly as recited in claim 17, wherein said mount includes a central mount plate, and a first mount plate and a second mount plate that each extend from said central mount plate to form a generally U-shape.

19. The bracket assembly as recited in claim 18, wherein said central mount plate includes a first mount arm and a second mount arm, and at least a portion of said omni directional pivot system is formed directly from said central mount plate.

20. The bracket assembly as recited in claim 19, comprising a weld pin mounted between said first mount arm and said second mount arm, wherein an arm attachment mount is received by said weld pin and is pivotable about one of said first pivot axis and said second pivot axis.

21. The bracket assembly as recited in claim 20, wherein said arm attachment mount includes a centering device.

22. A bracket assembly for a weightlifting system, comprising:

a mount;

an omni directional pivot system positioned on said mount and including a first pivot axis and a second pivot axis; and a release knob assembly mounted to said mount and including a biased latch member that is selectively actuated to detach said mount from a weight bar frame rack.

23. The bracket assembly as recited in claim 22, wherein said mount includes a central mount plate, and a first mount plate and a second mount plate that each extend from said central mount plate to form a generally U-shape.

24. The bracket assembly as recited in claim 23, wherein said central mount plate includes a first mount arm and a second mount arm, and at least a portion of said omni directional pivot system is formed directly from said central mount plate.

25. The bracket assembly as recited in claim 24, comprising a weld pin mounted between said first mount arm and said second mount arm, wherein an arm attachment mount is received by said weld pin and is pivotable about one of said first pivot axis and said second pivot axis.

26. The bracket assembly as recited in claim 22, wherein said mount includes a length that extends along a longitudinal axis, and said mount is slideably mountable along said longitudinal axis.

27. A bracket assembly for a weightlifting system, comprising:

a mount;

an omni directional pivot system positioned on said mount and including a first mount arm and a second mount arm cut out from said mount; and a multitude of mount studs that extend from an inner surface of said mount.

28. The bracket assembly as recited in claim 27, wherein said mount includes:

a first mount plate;

a second mount plate generally parallel to said first mount plate; wherein a first portion of said multitude of studs extend from said first mount plate; and a second portion of said multitude of studs extend from said second mount plate, said second portion of said multitude of studs facing toward said first portion of said multitude of studs.

29. The bracket assembly as recited in claim 28 wherein said first mount plate and said second mount plate extend from a central mount plate to form a generally U-shape.

30. The bracket assembly as recited in claim 29, wherein said central mount plate includes said first mount arm and said second mount arm, and including a weld pin mounted between said first mount arm and said second mount arm, wherein an arm attachment mount is received by said weld pin.

31. The bracket assembly as recited in claim 30, wherein said arm attachment mount includes a centering device.

* * * * *